US009869328B2

(12) United States Patent
Edwards

(10) Patent No.: US 9,869,328 B2
(45) Date of Patent: Jan. 16, 2018

(54) CANTILEVERED STATOR VANE AND STATOR ASSEMBLY FOR A ROTARY MACHINE

(71) Applicant: United Technologies Corporation, Hartford, CT (US)

(72) Inventor: William R. Edwards, Stratham, NH (US)

(73) Assignee: United Technologies Corporation, Farmington, CT (US)

( * ) Notice: Subject to any disclaimer, the term of this patent is extended or adjusted under 35 U.S.C. 154(b) by 282 days.

(21) Appl. No.: 14/753,810

(22) Filed: Jun. 29, 2015

(65) Prior Publication Data

US 2016/0377092 A1 Dec. 29, 2016

(51) Int. Cl.

| | |
|---|---|
| ***F01D 25/24*** | (2006.01) |
| ***F04D 29/56*** | (2006.01) |
| ***F04D 29/16*** | (2006.01) |
| ***F04D 29/32*** | (2006.01) |
| ***F04D 29/52*** | (2006.01) |
| ***F04D 29/54*** | (2006.01) |

(52) U.S. Cl.

CPC ..... *F04D 29/563* (2013.01); *F01D 25/246* (2013.01); *F04D 29/161* (2013.01); *F04D 29/321* (2013.01); *F04D 29/522* (2013.01); *F04D 29/542* (2013.01)

(58) Field of Classification Search

CPC . F01D 9/04; F01D 9/041; F01D 9/042; F01D 9/02; F01D 25/06; F01D 25/24; F01D 25/26; F01D 25/246; F01D 25/28; F04D 29/161; F04D 29/321; F04D 29/524; F04D 29/522; F04D 29/563

See application file for complete search history.

(56) References Cited

U.S. PATENT DOCUMENTS

| | | | | |
|---|---|---|---|---|
| 764,450 | A | 7/1904 | Geisenhoener | |
| 3,326,523 | A * | 6/1967 | Bobo | F01D 9/042 415/209.3 |
| 2014/0255179 | A1 | 9/2014 | Fielding et al. | |

OTHER PUBLICATIONS

Extended European Search Report dated Nov. 2, 2016 in European Application No. 16176976.5.

* cited by examiner

*Primary Examiner* — Gregory Anderson
*Assistant Examiner* — Danielle M Christensen
(74) *Attorney, Agent, or Firm* — Snell & Wilmer L.L.P.

(57) ABSTRACT

A stator vane assembly is provided. The stator vane assembly may comprise a stator vane, an outer shroud, and a spring. A first end of the stator vane may be fixed to an inner diameter (ID) surface of a vane platform. A slot may be disposed in a surface of the outer shroud, wherein a portion of the stator vane is configured to be located within the slot. In various embodiments, the stator vane may be configured to translate in a radial direction in response to a force between the stator vane and a rotor. In various embodiments, the spring may be configured to be coupled to an outer diameter (OD) surface of the vane platform, wherein the spring is configured to bias the ID surface of the vane platform toward the outer shroud.

19 Claims, 6 Drawing Sheets

CANTILEVERED STATOR VANE AND STATOR ASSEMBLY FOR A ROTARY MACHINE

FIELD

The present disclosure relates generally to stator vane assemblies of a gas turbine engine and, more specifically, to a stator vane assembly positioned within a high pressure compressor section.

BACKGROUND

Gas turbine engines generally include a compressor to pressurize inflowing air, a combustor to burn a fuel in the presence of the pressurized air, and a turbine to extract energy from the resulting combustion gases. The compressor may include multiple rotatable compressor rotor blade arrays separated by multiple stator vane arrays. A stator vane array may be coupled to a radially inward portion of an annular inner compressor case via an outer shroud. Minimal stator vane tip clearance between stator vanes and a rotor is desired for maximum efficiency. Due to thermal expansion and centrifugal force, clearance between the stator vane array and the rotor may undesirably vary during operation.

SUMMARY

A stator vane assembly is provided. In various embodiments, the stator vane assembly may comprise a stator vane, an outer shroud, and a spring. A first end of the stator vane may be fixed to an inner diameter (ID) surface of a vane platform. A slot may be disposed in a surface of the shroud, wherein a portion of the stator vane is configured to be located within the slot. In various embodiments, the stator vane may be configured to translate in a radial direction in response to a force between the stator vane and a rotor. In various embodiments, the spring may be configured to be coupled to an outer diameter (OD) surface of the vane platform, wherein the spring may be configured to bias the ID surface of the vane platform toward the outer shroud.

In a further embodiment of any of the foregoing embodiments, the vane platform may comprise a vane platform tab, wherein at least a portion of the vane platform tab may be configured to slide into the slot, wherein a geometry of the vane platform tab may be complementary to the geometry of the slot. In various embodiments, the rotor may be located radially inward of the stator vane assembly. In various embodiments, the outer shroud may be configured to be coupled to a case, wherein the case is located radially outward of the outer shroud. In various embodiments, the spring may be coupled between the case and the vane platform, wherein the spring may be configured to at least one of compress and decompress in response to the translating. In various embodiments, the force between in the rotor and the stator vane may be created in response to a load path between the stator vane and the rotor, wherein the load path may be introduced in response to at least one of centrifugal force, gravitational force, and thermal expansion. In various embodiments, the spring may comprise at least one of a circumferentially segmented spring and a coil spring. In various embodiments, the stator vane may comprise an airfoil.

A compressor section is provided. In various embodiments, the compressor section may comprise a stator vane, an outer shroud, a case, and a spring. A first end of the stator vane may be fixed to an inner diameter (ID) surface of a vane platform. A slot may be disposed in a surface of the outer shroud, wherein a portion of the stator vane is configured to be located within the slot. In various embodiments, the stator vane may be configured to translate in a radial direction in response to a force between the stator vane and a rotor. The case may be located radially outward of the outer shroud. The outer shroud may be coupled to the case. In various embodiments, the spring may be coupled between an outer diameter (OD) surface of the vane platform and an inner diameter surface of the case. The spring may be configured to bias the ID surface of the vane platform toward the outer shroud.

In a further embodiment of any of the foregoing embodiments, the vane platform may comprise a vane platform tab, wherein at least a portion of the vane platform tab may be configured to slide into the slot, wherein a geometry of the vane platform tab may be complementary to the geometry of the slot. In various embodiments, the rotor may be located radially inward of the stator vane assembly. In various embodiments, the force between the rotor and the stator vane may be created in response to a load path between the stator vane and the rotor, wherein the load path may be introduced in response to at least one of centrifugal force, gravitational force, and thermal expansion. In various embodiments, the spring may be configured to at least one of compress and decompress in response to the translating. In various embodiments, the spring may comprise at least one of a circumferentially segmented spring and a coil spring. In various embodiments, the stator vane may comprise an airfoil.

A gas turbine engine is provided. In various embodiments, the gas turbine engine may include a compressor section. In various embodiments, the compressor section may comprise a stator vane, a rotor, an outer shroud, a case, and a spring. A first end of the stator vane may be fixed to an inner diameter (ID) surface of a vane platform. The rotor may be located radially inward of the stator vane assembly. A slot may be disposed in a surface of the outer shroud. A portion of the stator vane may be configured to be located within the slot. In various embodiments, the stator vane may be configured to translate in a radial direction in response to a force between the stator vane and a rotor. The case may be located radially outward of the outer shroud. The outer shroud may be coupled to the case. In various embodiments, the spring may be coupled between an outer diameter (OD) surface of the vane platform and an inner diameter surface of the case. The spring may be configured to at least one of compress and decompress in response to the translating.

In a further embodiment of any of the foregoing embodiments, at least a portion of the vane platform tab may be configured to slide into the slot, wherein a geometry of the vane platform tab nay be complementary to the geometry of the slot. In various embodiments, the force between the rotor and the stator vane may be created in response to a load path between the stator vane and the rotor, wherein the load path is introduced in response to at least one of centrifugal force, gravitational force, and thermal expansion. In various embodiments, the spring may comprise at least one of a circumferentially segmented spring and a coil spring. In various embodiments, the stator vane may comprise an airfoil.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

Figure 1:
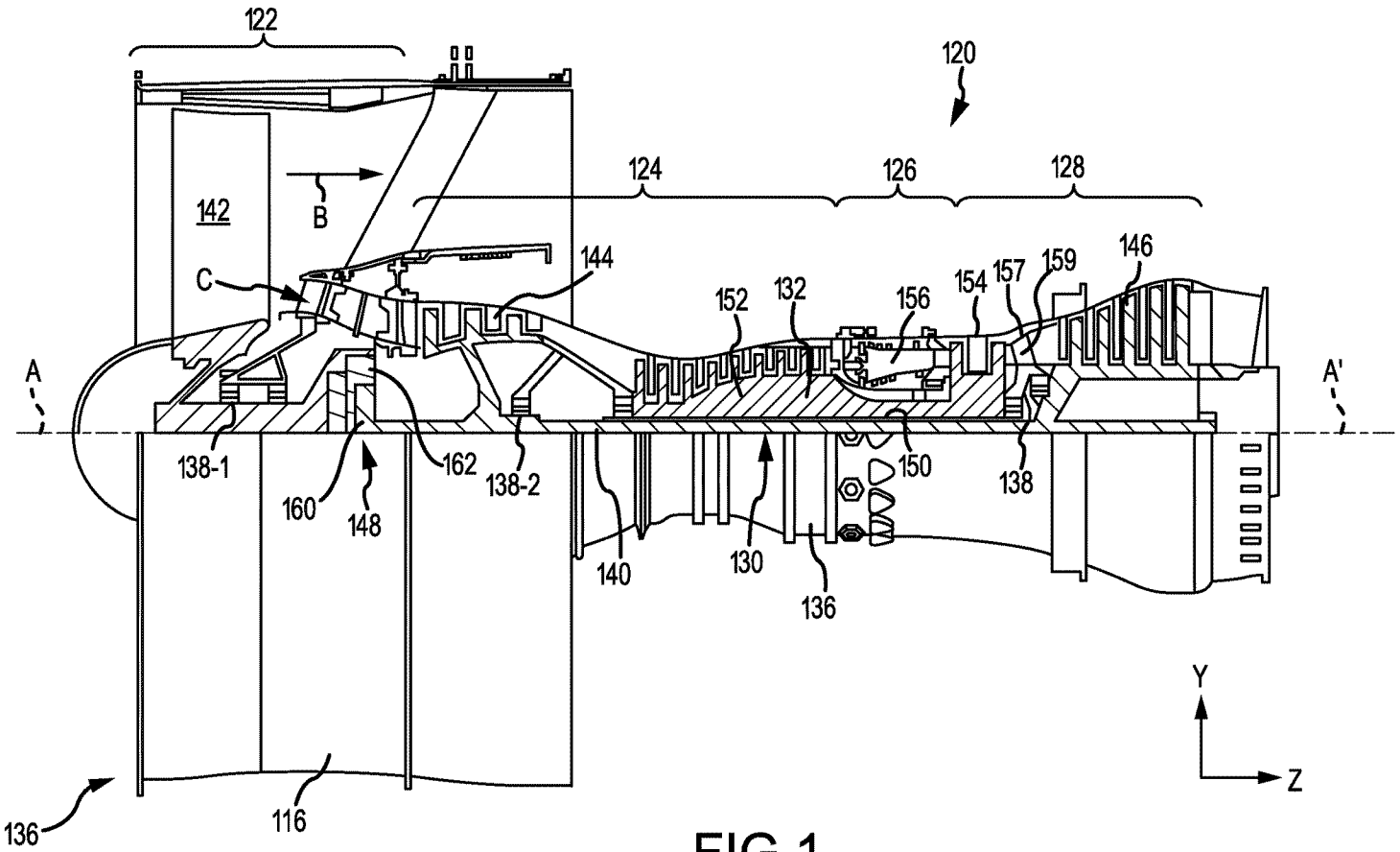
FIG. 1 illustrates an exemplary gas turbine engine, in accordance with various embodiments.

The detailed description of exemplary embodiments herein makes reference to the accompanying drawings, which show exemplary embodiments by way of illustration. While these exemplary embodiments are described in sufficient detail to enable those skilled in the art to practice the disclosure, it should be understood that other embodiments may be realized and that logical changes and adaptations in design and construction may be made in accordance with this disclosure and the teachings herein. Thus, the detailed description herein is presented for purposes of illustration only and not of limitation. The scope of the disclosure is defined by the appended claims. For example, the steps recited in any of the method or process descriptions may be executed in any order and are not necessarily limited to the order presented. Furthermore, any reference to singular includes plural embodiments, and any reference to more than one component or step may include a singular embodiment or step.

Also, any reference to attached, fixed, connected or the like may include permanent, removable, temporary, partial, full and/or any other possible attachment option. Additionally, any reference to without contact (or similar phrases) may also include reduced contact or minimal contact. Moreover, surface shading lines may be used throughout the figures to denote different parts but not necessarily to denote the same or different materials.

As used herein, "aft" refers to the direction associated with the tail (e.g., the back end) of an aircraft, or generally, to the direction of exhaust of the gas turbine. As used herein, "forward" refers to the direction associated with the nose (e.g., the front end) of an aircraft, or generally, to the direction of flight or motion.

Jet engines often include one or more stages of stator vane assemblies. Each stator vane assembly may comprise one or more sections or segments. These sections or segments may be referred to collectively as a stator vane array. Each stator vane section may include a plurality of stator vanes, also referred to as a cluster of vanes, detachably coupled to an outer shroud which may be coupled to an inner compressor case. A stator vane assembly may be disposed radially outward of a rotor or rotor disk relative to an engine axis. A stator vane array may thus comprise an annular structure comprising a plurality of stator vane segments, each stator vane segment disposed radially about a rotor, which may rotate, during operation, within the stator vane assembly.

During operation of a gas turbine engine, a rotor may rotate about an engine axis within the stator vane assembly as previously described. During operation, it may be desirable to minimize the gap between compressor stator vane tips and the rotor to increase the efficiency of the compressor section of a gas turbine engine. However, due to thermal expansion and centrifugal force from the rotating rotor, the rotor may expand radially outward towards the stator vane assembly, thereby decreasing stator vane tip clearance. Furthermore, the stator vane may also thermally expand. Tip strike may occur when a stator vane tip strikes or rubs against the rotor which may introduce a load path between the stator vane and the rotor. Excessive loading between the stator vane and the rotor can be detrimental to the operation of a gas turbine engine. In order to minimize stator vane tip clearance, prevent excessive rotor to stator vane loading, and to increase efficiency, a system may be provided in order to allow radial displacement of the stator vanes within the gas turbine engine. Accordingly, compressor section efficiency may increase.

In various embodiments and with reference to FIG. 1, a gas turbine engine 120 is provided. Gas turbine engine 120 may be a two-spool turbofan that generally incorporates a fan section 122, a compressor section 124, a combustor section 126 and a turbine section 128. Alternative engines may include, for example, an augmentor section among other systems or features. In operation, fan section 122 can drive air along a bypass flow-path B while compressor section 124 can drive air along a core flow-path C for compression and communication into combustor section 126 then expansion through turbine section 128. Although depicted as a turbofan gas turbine engine 120 herein, it should be understood that the concepts described herein are not limited to use with turbofans as the teachings may be applied to other types of turbine engines including three-spool architectures.

Gas turbine engine 120 may generally comprise a low speed spool 130 and a high speed spool 132 mounted for rotation about an engine central longitudinal axis A-A' relative to an engine static structure 136 via one or more bearing systems 138 (shown as bearing system 138-1 and bearing system 138-2 in FIG. 1). It should be understood that various bearing systems 138 at various locations may alternatively or additionally be provided including, for example, bearing system 138, bearing system 138-1, and bearing system 138-2.

Low speed spool 130 may generally comprise an inner shaft 140 that interconnects a fan 142, a low pressure (or first) compressor section 144 and a low pressure (or first) turbine section 146. Inner shaft 140 may be connected to fan 142 through a geared architecture 148 that can drive fan 142 at a lower speed than low speed spool 130. Geared architecture 148 may comprise a gear assembly 160 enclosed within a gear housing 162. Gear assembly 160 couples inner shaft 140 to a rotating fan structure. High speed spool 132 may comprise an outer shaft 150 that interconnects a high pressure compressor ("HPC") 152 (e.g., a second compressor section) and high pressure (or second) turbine section 154. A combustor 156 may be located between HPC 152 and high pressure turbine 154. A mid-turbine frame 157 of engine static structure 136 may be located generally between high pressure turbine 154 and low pressure turbine 146. Mid-turbine frame 157 may support one or more bearing systems 138 in turbine section 128. Inner shaft 140 and outer shaft 150 may be concentric and rotate via bearing systems 138 about the engine central longitudinal axis A-A', which is collinear with their longitudinal axes. As used herein, a "high pressure" compressor or turbine experiences a higher pressure than a corresponding "low pressure" compressor or turbine.

The core airflow C may be compressed by low pressure compressor 144 then HPC 152, mixed and burned with fuel in combustor 156, then expanded over high pressure turbine 154 and low pressure turbine 146. Mid-turbine frame 157 includes airfoils 159 which are in the core airflow path. Low pressure turbine 146 and high pressure turbine 154 rotationally drive the respective low speed spool 130 and high speed spool 132 in response to the expansion.

Gas turbine engine 120 may be, for example, a high-bypass geared aircraft engine. In various embodiments, the bypass ratio of gas turbine engine 120 may be greater than about six (6). In various embodiments, the bypass ratio of gas turbine engine 120 may be greater than ten (10). In various embodiments, geared architecture 148 may be an epicyclic gear train, such as a star gear system (sun gear in meshing engagement with a plurality of star gears supported by a carrier and in meshing engagement with a ring gear) or other gear system. Geared architecture 148 may have a gear reduction ratio of greater than about 2.3 and low pressure turbine 146 may have a pressure ratio that is greater than about 5. In various embodiments, the bypass ratio of gas turbine engine 120 is greater than about ten (10:1). In various embodiments, the diameter of fan 142 may be significantly larger than that of the low pressure compressor 144, and the low pressure turbine 146 may have a pressure ratio that is greater than about 5:1. Low pressure turbine 146 pressure ratio may be measured prior to inlet of low pressure turbine 146 as related to the pressure at the outlet of low pressure turbine 146 prior to an exhaust nozzle. It should be understood, however, that the above parameters are exemplary of various embodiments of a suitable geared architecture engine and that the present disclosure contemplates other gas turbine engines including direct drive turbofans.

Figure 2:
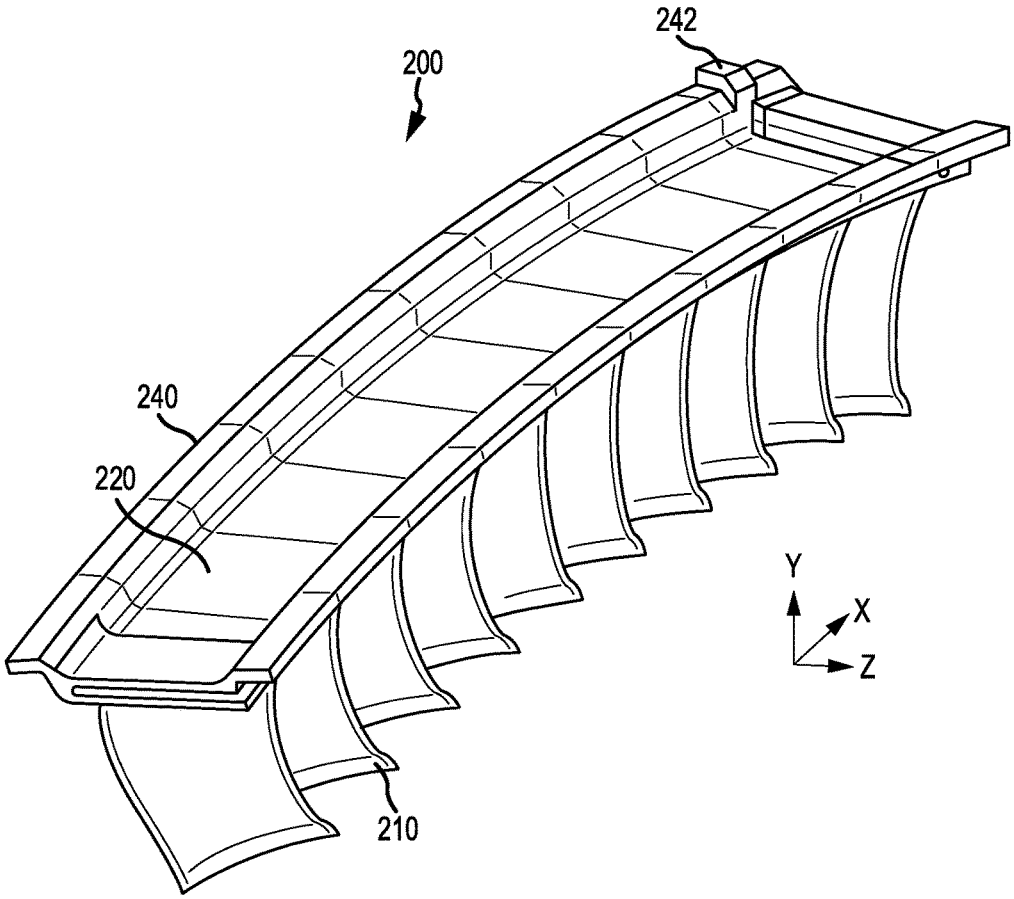
FIG. 2 illustrates a perspective view of a stator vane segment, in accordance with various embodiments.

With reference to FIG. 2, a stator vane segment 200 is illustrated with a plurality of stator vanes, such as stator vane 210, in an installed position relative to an outer shroud 240. Stator vane segment 200 may include outer shroud 240 and a plurality of stator vanes such as stator vane 210. Stator vane 210 may be detachably coupled to outer shroud 240. Stator vane 210 may include vane platform 220. Stator vane 210 may be configured to be installed in outer shroud 240 such that vane platform 220 seats directly adjacent to a vane platform of a neighboring stator vane. Outer shroud 240 may include shroud tab 242. Shroud tab 242 may be located on a radially outer surface of outer shroud 240. Shroud tab 242 may be configured to prevent outer shroud 240 from rotating in a circumferential direction when in an installed position.

Figure 3A:
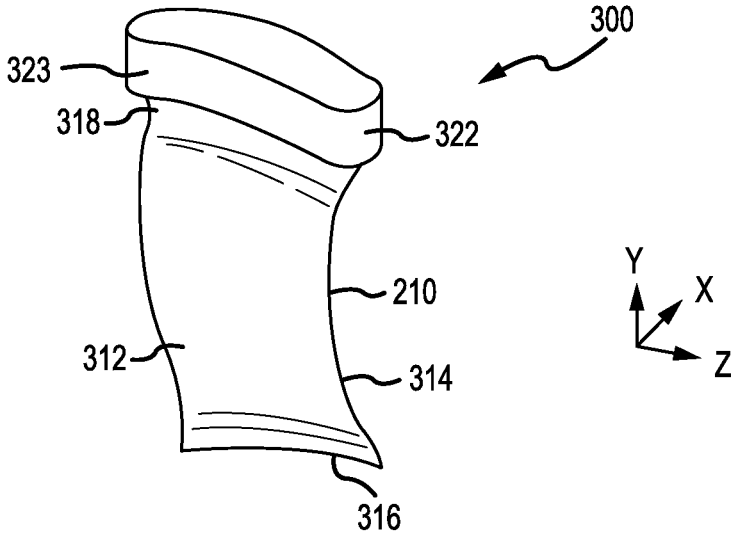
FIG. 3A illustrates a perspective view of a stator vane, in accordance with various embodiments.
Figure 3B:
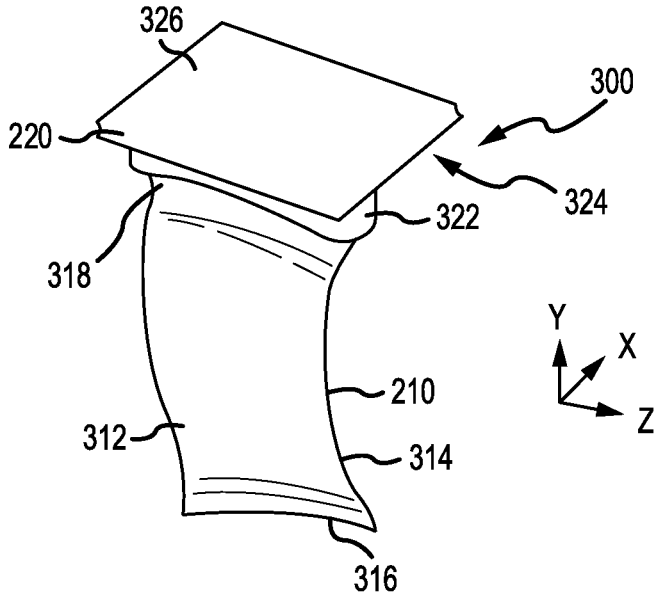
FIG. 3B illustrates a perspective view of a stator vane fixed to a stator vane platform, in accordance with various embodiments.
Figure 4:
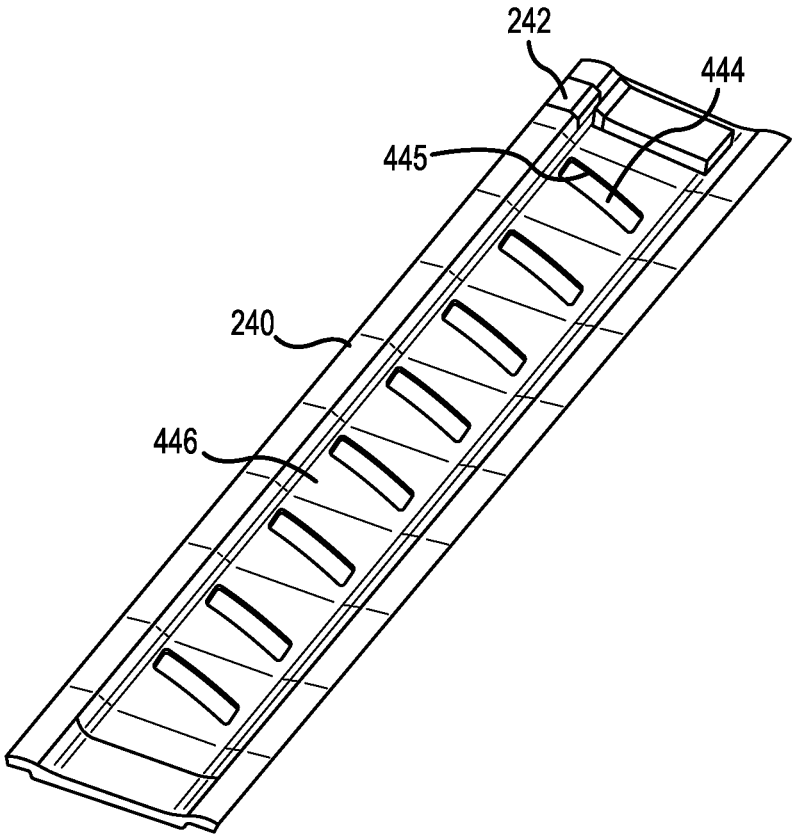
FIG. 4 illustrates a perspective view of an outer shroud, in accordance with various embodiments.

With respect to FIGS. 3A-4, elements with like element numbering as depicted in FIG. 2 are intended to be the same and will not be repeated for the sake of clarity.

With reference to FIG. 3A, a stator vane without a vane platform is illustrated for clarity. Stator vane 210 may be fixed to a vane platform tab 322. Vane platform tab 322 may be integral to stator vane 210. Stator vane 210 may extend radially inwards (in the negative y-direction in FIG. 3A) from vane platform tab 322. Stator vane 210 may comprise an airfoil. With momentary reference to FIG. 4, the geometry of vane platform tab 322 may be complementary to slot 444. At least a portion of vane platform tab 322 may be located within slot 444 when in an installed position. The outer surface 323 of vane platform tab 322 may engage with the inner surface 445 of slot 444 when in an installed position, thereby preventing stator vane 210 from shifting in a circumferential direction (x-direction in FIG. 3A) or axial direction (z-direction in FIG. 3A).

With reference to FIG. 3B, a stator vane with a vane platform 220 is illustrated. Vane platform tab 322 may be fixed to vane platform 220. Vane platform tab 322 may be integral to vane platform 220. For example, vane platform tab 322 and vane platform 220 may be manufactured as a single part. Vane platform 220 may comprise outer diameter (OD) surface 326. Vane platform 220 may comprise inner diameter (ID) surface 324.

With reference to FIG. 4, outer shroud 240 is illustrated, in accordance with various embodiments. A plurality of slots, such as slot 444, may be disposed in outer shroud 240. Slot 444 may be configured to allow a vane and vane platform tab to slide into slot 444 from a radially outward direction to a radially inward direction into an installed position. Outer shroud 240 may be configured to be coupled to a plurality of other outer shrouds, forming an annular ring. Outer shroud 240 may comprise outer diameter (OD) surface 446.

Figure 5A:
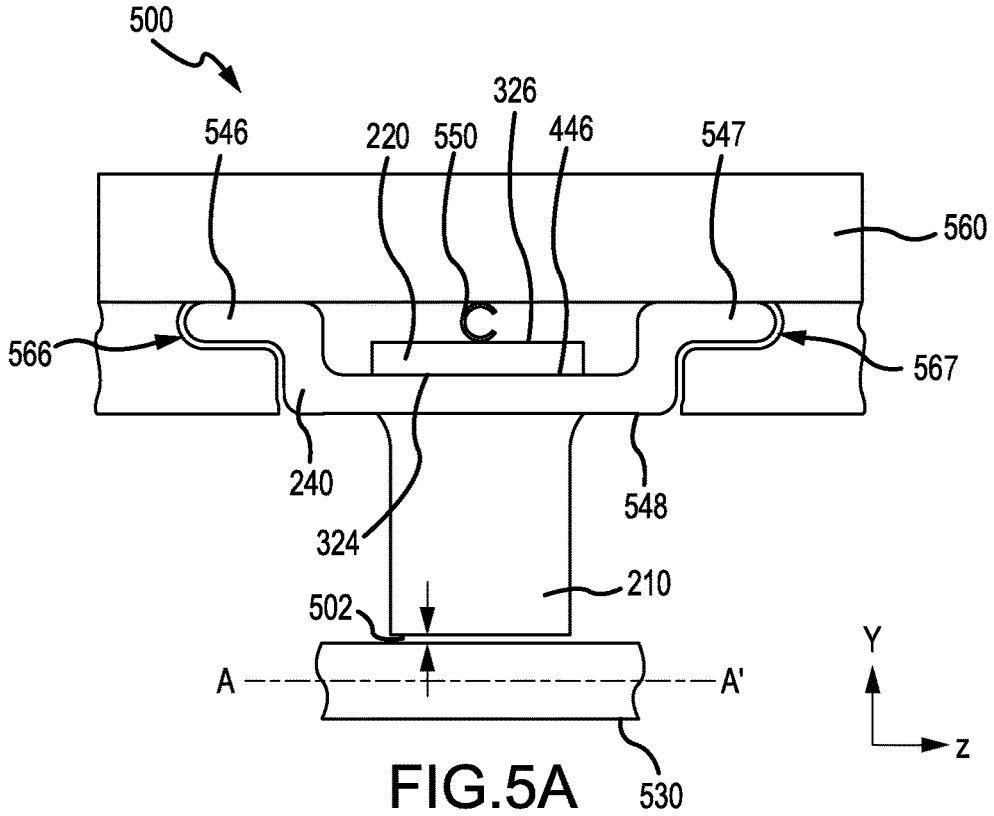
FIG. 5A illustrates a cross-section view of a stator vane assembly with stator vane tip clearance, in accordance with various embodiments.
Figure 5B:
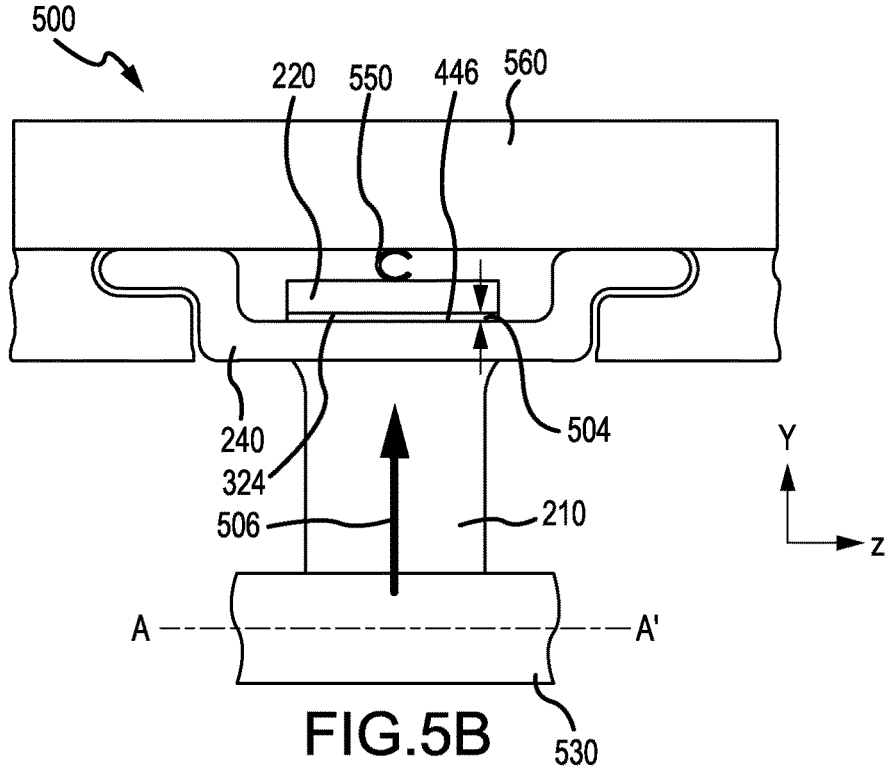
FIG. 5B illustrates a cross-section view of a stator vane assembly undergoing stator vane tip strike or rub, in accordance with various embodiments.
Figure 5C:
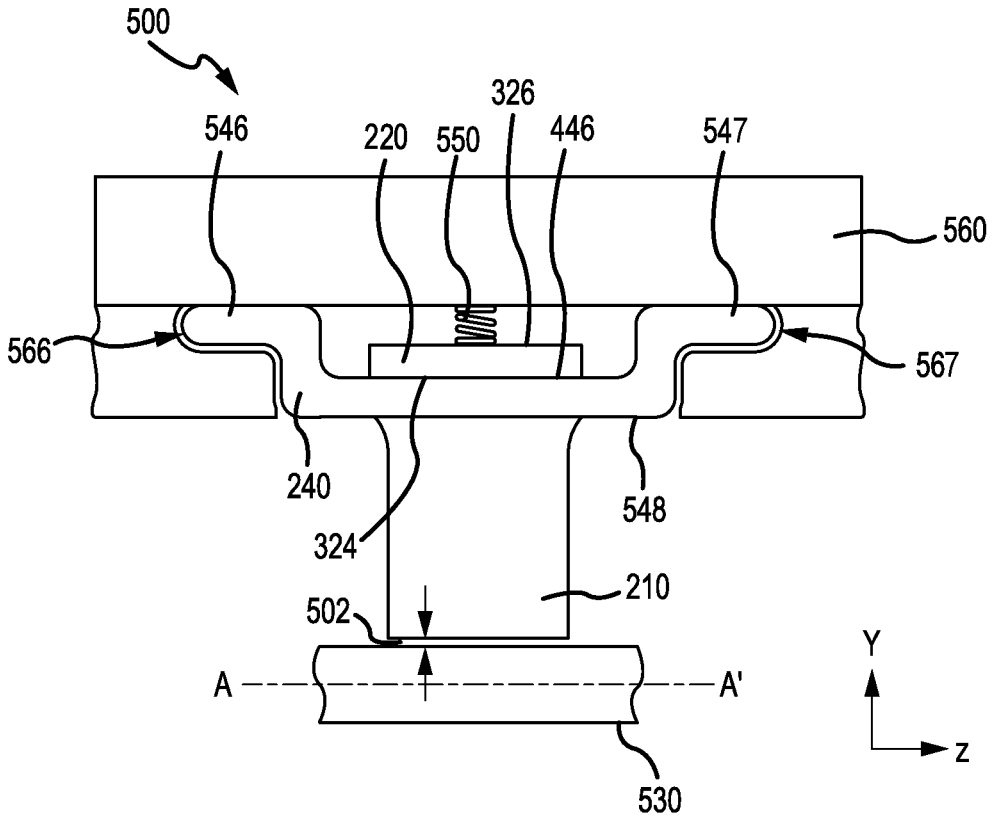
FIG. 5C illustrates a cross-section view of a stator vane assembly with stator vane tip clearance, with a coil spring, in accordance with various embodiments.

With respect to FIGS. 5A-5C, elements with like element numbering as depicted in FIGS. 2-3B are intended to be the same and will not be repeated for the sake of clarity.

With reference to FIG. 5A, a cross-section view of a stator vane assembly having stator vane tip clearance is illustrated, in accordance with various embodiments. Case 560 may comprise channel 566. Channel 566 may extend about the circumference of case 560. Similarly, case 560 may comprise channel 567. Channel 567 may be similar to channel 566. Outer shroud 240 may include shroud tab 546. Shroud tab 546 may extend in an axial direction (negative z-direction in FIG. 5A). Outer shroud 240 may include shroud tab 547. Shroud tab 547 may be similar to shroud tab 546. Shroud tab 547 may extend in an axial direction (z-direction). Shroud tab 547 may extend in an opposite direction as shroud tab 546. Shroud tab 546 and shroud tab 547 may be configured to slide into channel 566 and channel 567, respectively. Accordingly, outer shroud 240 may be configured to be coupled to case 560 in an installed position. Outer shroud 240 may be fixed to case 560 when in an installed position. When in an installed position, outer shroud 240 may be prevented, by case 560, from shifting in an axial direction (z-direction). In various embodiments, case 560 may comprise a first portion and a second portion. In various embodiments, case 560 may comprise an annular ring. In various embodiments, case 560 may comprise an inner compressor case.

In various embodiments, vane platform 220 may seat against outer shroud 240 when in an installed position. Inner diameter (ID) surface 324 of vane platform 220 may be compressed against outer diameter (OD) surface 446 of outer shroud 240 by spring 550 when in an installed position, thereby creating a seal. Accordingly, with momentary reference to FIG. 1 and FIG. 4, air in core airflow C may be prevented from leaking through slot 444. In various embodiments, spring 550 may be coupled between vane platform 220 and case 560. Spring 550 may extend around an entire circumference of stator vane assembly 500, thereby creating an annular ring when in an installed position. In various embodiments, spring 550 may comprise several segments. In various embodiments, spring 550 may comprise a circumferentially segmented spring. In various embodiments, spring 550 may comprise a coil spring. Spring 550 may be configured to bias vane platform 220 against outer shroud 240, as previously described, while allowing stator vane 210 to translate in a radial direction.

Rotor 530 may be located radially inward of stator vane 210. Rotor 530 may be configured to rotate about engine axis A-A'. Gap 502 may exist between stator vane 210 and rotor 530. In various embodiments, gap 502 may be configured to be minimal Gap 502 may increase in response to a decrease in temperature. Gap 502 may decrease in response to an increase in temperature. In various embodiments, gap 502 may be determined during manufacture and/or assembly of stator vane assembly 500.

In various embodiments, during manufacture of stator vane assembly 500, a wear-in process may be used to establish gap 502. For example, stator vane 210 may be manufactured such that a gap does not exist between stator vane 210 and rotor 530. During a wear-in process, stator vane 210 may undergo thermal expansion while rotor 530 may rotate and rub against stator vane 210 while undergoing centrifugal and/or thermal expansion, thereby machining stator vane 210. Afterwards, stator vane 210 and rotor 530 may decrease in temperature and contract, thereby establishing a gap between stator vane 210 and rotor 530. In various embodiments, inner diameter (ID) surface 548 of outer shroud 240 may comprise a flow surface.

With respect to FIGS. 5B-5C, elements with like element numbering as depicted in FIG. 5A are intended to be the same and will not be repeated for the sake of clarity.

With reference to FIG. 5B, a cross-section view of stator vane assembly 500 undergoing stator vane tip strike is illustrated, in accordance with various embodiments. In various embodiments, during operation, stator vane assembly 500 may undergo thermal expansion. In various embodiments, rotor 530 may undergo centrifugal expansion when rotating. Stator vane 210 may contact or rub against rotor 530. Accordingly, a load path 506 may be introduced between rotor 530, stator vane 210, spring 550, and case 560. In various embodiments, stator vane 210 may translate in a radially outward direction (y-direction in FIG. 5B) in response to load path 506 being introduced, thereby creating gap 504 between vane platform 220 and outer shroud 240. Accordingly, gap 504 may exist between ID surface 324 of vane platform 220 and OD surface 446 of outer shroud 240 in response to stator vane assembly 500 undergoing stator vane tip strike. In various embodiments, spring 550 may be compressed during stator vane tip strike. In various embodiments, spring 550 may apply a force on stator vane 210 in a radially inward direction (negative y-direction in FIG. 5B) such that stator vane 210 is displaced radially inward in response to a decrease in temperature of stator vane assembly 500 until the ID surface 324 of vane platform 220 and OD surface 446 of outer shroud 240 are compressed together.

With respect to FIG. 5C, elements with like element numbering as depicted in FIG. 5B are intended to be the same and will not be repeated for the sake of clarity.

With reference to FIG. 5C, a cross-section view of a stator vane assembly with a coil spring is illustrated, in accordance with various embodiments. As previously mentioned, spring 550 may comprise a coil spring. In various embodiments, a coil spring may be placed between each vane platform 220 and case 560.

In various embodiments, stator vane 210, outer shroud 240, rotor 530, spring 550, and/or case 560 may comprise various metallic materials including, but not limited to, steel and austenitic nickel-chromium-based alloys.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A stator vane assembly, comprising:

a stator vane, wherein a first end of the stator vane is fixed to an inner diameter (ID) surface of a vane platform;

an outer shroud, wherein the outer shroud comprises a slot extending radially through the outer shroud, wherein a portion of the stator vane is configured to be located within the slot, wherein the stator vane is configured to translate relative to the outer shroud in a radial direction in response to a force between the stator vane and a rotor; and a spring, wherein the spring is configured to be coupled to an outer diameter (OD) surface of the vane platform, wherein the spring is configured to bias the ID surface of the vane platform toward the outer shroud wherein the outer shroud is configured to be coupled to a case located radially outward from the outer shroud.

2. The stator vane assembly of claim 1, wherein the vane platform comprises a vane platform tab, wherein at least a portion of the vane platform tab is configured to slide into the slot, wherein a geometry of the vane platform tab is complementary to the geometry of the slot.

3. The stator vane assembly of claim 1, wherein the rotor is located radially inward of the stator vane assembly.

4. The stator vane assembly of claim 3, wherein the force between in the rotor and the stator vane is created in response to a load path between the stator vane and the rotor, wherein the load path is introduced in response to at least one of centrifugal force, gravitational force, and thermal expansion.

5. The stator vane assembly of claim 1, wherein the spring is coupled between the case and the vane platform, wherein the spring is configured to at least one of compress and decompress in response to the translating.

6. The stator vane assembly of claim 1, wherein the spring comprises at least one of a circumferentially segmented spring and a coil spring.

7. The stator vane assembly of claim 1, wherein the stator vane comprises an airfoil.

8. A compressor section, comprising:

a stator vane, wherein a first end of the stator vane is fixed to an inner diameter (ID) surface of a vane platform;

an outer shroud, wherein the outer shroud comprises a slot extending radially through the outer shroud, wherein a portion of the stator vane is configured to be located within the slot, wherein the stator vane is configured to translate relative to the outer shroud in a radial direction in response to a force between the stator vane and a rotor;

a case, wherein the outer shroud is located radially inward of the case, wherein the outer shroud is coupled to the case; and a spring, wherein the spring is coupled between an outer diameter (OD) surface of the vane platform and an inner diameter surface of the case, wherein the spring is configured to bias the ID surface of the vane platform toward the outer shroud.

9. The compressor section of claim 8, wherein the vane platform comprises a vane platform tab, wherein at least a portion of the vane platform tab is configured to slide into the slot, wherein a geometry of the vane platform tab is complementary to the geometry of the slot.

10. The compressor section of claim 8, wherein the rotor is located radially inward of the stator vane assembly.

11. The compressor section of claim 10, wherein the force between the rotor and the stator vane is created in response to a load path between the stator vane and the rotor wherein the load path is introduced in response to at least one of centrifugal force, gravitational force, and thermal expansion.

12. The compressor section of claim 8, wherein the spring is configured to at least one of compress and decompress in response to the translating.

13. The compressor section of claim 8, wherein the spring comprises at least one of a circumferentially segmented spring and a coil spring.

14. The compressor section of claim 8, wherein the stator vane comprises an airfoil.

15. A gas turbine engine, comprising:

a compressor section, comprising:

a stator vane, wherein a first end of the stator vane is fixed to an inner diameter (ID) surface of a vane platform;

a rotor, wherein the rotor is located radially inward of the stator vane assembly;

an outer shroud, wherein the outer shroud comprises a slot extending radially through the outer shroud, wherein a portion of the stator vane is configured to be located within the slot, wherein the stator vane is configured to translate relative to the outer shroud in a radial direction in response to a force between the stator vane and the rotor;

a case, wherein the outer shroud is located radially inward of the case, wherein the outer shroud is coupled to the case; and a spring, wherein the spring is coupled between an outer diameter (OD) surface of the vane platform and an inner diameter surface of the case, wherein the spring is configured to bias the ID surface of the vane platform toward the outer shroud, wherein the spring is configured to at least one of compress and decompress in response to the translating.

16. The gas turbine engine of claim 15, wherein the vane platform comprises a vane platform tab, wherein at least a portion of the vane platform tab is configured to slide into the slot, wherein a geometry of the vane platform tab is complementary to the geometry of the slot.

17. The gas turbine engine of claim 15, wherein the force between the rotor and the stator vane is created in response to a load path between the stator vane and the rotor, wherein the load path is introduced in response to at least one of centrifugal force, gravitational force, and thermal expansion.

18. The gas turbine engine of claim 15, wherein the spring comprises at least one of a circumferentially segmented spring and a coil spring.

19. The stator vane assembly of claim 15, wherein the stator vane comprises an airfoil.

* * * * *